US006142458A

United States Patent [19]

Howk

[11] Patent Number: 6,142,458

[45] Date of Patent: Nov. 7, 2000

[54] MIXING SYSTEM FOR DISPERSION OF GAS INTO LIQUID MEDIA

[75] Inventor: Richard A Howk, Pittsford, N.Y.

[73] Assignee: General Signal Corporation, Rochester, N.Y.

[21] Appl. No.: 09/182,747

[22] Filed: Oct. 29, 1998

[51] Int. Cl.[7] ..... B01F 3/04

[52] U.S. Cl. ..... 261/93; 261/123; 261/124

[58] Field of Search ..... 261/93, 121.1, 261/123, 124

[56] References Cited

U.S. PATENT DOCUMENTS

| | | | |
|---|---|---|---|
| 1,632,758 | 6/1927 | Fulweiler et al. . | |
| 3,536,305 | 10/1970 | Lefrancois | 261/93 |
| 3,806,452 | 4/1974 | Walker | 261/93 |
| 3,814,396 | 6/1974 | Di Gregorio et al. . | |
| 4,066,722 | 1/1978 | Pietruszewski et al. | 261/93 |
| 4,228,112 | 10/1980 | Hise . | |
| 4,519,959 | 5/1985 | Takeuchi et al. . | |
| 4,643,852 | 2/1987 | Koslow . | |
| 4,660,989 | 4/1987 | Davis . | |

FOREIGN PATENT DOCUMENTS

| | | | |
|---|---|---|---|
| 1176930 | 9/1985 | Russian Federation | 261/93 |

*Primary Examiner*—David A. Simmons
*Assistant Examiner*—Robert A. Hopkins
*Attorney, Agent, or Firm*—Martin Lukacher; Kenneth J. Lukacher

[57] ABSTRACT

In order to sparge gas into a liquid or liquid suspension in a tank wherein a principally axial flow pattern downwardly towards the bottom of the tank and then upwardly along the side wall of the tank returning axially downward is established by an axial flow impeller, a disc of a diameter less than the diameter of the impeller is spaced axially therefrom in the direction of the outlet flow towards the bottom of the tank from the impeller so as to turn the axial flow, radially, thereby establishing a pressure gradient which prevents the collection of gas released by a sparge between the disc and the bottom of the tank and flooding of the impeller. The gas is released in the axial flow from the tip region of the impeller thereby facilitating the shearing of the gas into fine bubbles promoting mass transfer of the gaseous phase into the liquid phase in the tank. Since flooding is inhibited, as much as six times the volume of gas (gas rate) can be handled as may be the case without the disc.

13 Claims, 5 Drawing Sheets

MIXING SYSTEM FOR DISPERSION OF GAS INTO LIQUID MEDIA

DESCRIPTION

The present invention relates to mixing systems and particularly to mixing systems which disperse or sparge gas or other fluids into a liquid (by which term is meant to include liquid suspensions) and which enhance gas handling capacity. The systems provided by the invention are useful especially for mass-transfer of the gas or other fluids into a liquid phase in a tank to promote chemical reactions or other processes which rely upon the introduction and blending of gas or other fluids with the liquid in the tank.

The gas handling capability of mixing systems using axial flow impellers is limited by the tendency for such impellers to flood. Upon flooding, the gas flow predominates over the pumping action of the impeller, and the rate at which gas is introduced has been limited to avoid flooding. In U.S. Pat. No. 4,882,098 issued Nov. 21, 1989 to Ronald J. Weetman, a mixing system for sparging gas in a tank, where circulation is established by an axial flow impeller, is disclosed. In the Weetman system the sparge is located in a manner to reduce the effects of flooding and increase the gas rate which can be handled. Other systems using axial flow impellers have not attacked the flooding problem directly, but have proposed various geometrical relationships between the impeller and the sparge. See Davis, U.S. Pat. No. 4,660,989, Apr. 28, 1997; and Di Gregorio, U.S. Pat. No. 3,814,986, Jun. 4, 1974. Other proposals have included baffles for distributing the gas from a sparge device. See Fulweiler, U.S. Pat. No. 1,632,758, Jun. 14, 1927; Hise, U.S. Pat. No. 4,228,112, Oct. 14, 1980, Takeuchi, U.S. Pat. No. 4,519,959, May 28, 1985; and Koslow, U.S. Pat. No. 4,643,852, Feb. 17, 1987.

It is a feature of the invention to provide a mixing system whereby gas handling capabilities are enhanced by hydraulically inhibiting the collection of gas on the axial flow impeller and redirecting a portion of the axial flow discharge to effectively inhibit and forestalling flooding. The hydraulic means provided by the invention may be implemented with a simple disc in such geometrical relationship with the impeller and the sparge that the flow produced by the impeller creates a pressure differential which prevents the gas stalling the tips of the impellers which prevents cavitation, but without, as might otherwise be expected with a disc in close proximity to the impeller, interfering with the axial flow from the impeller into which the gas is released from the sparge.

Accordingly, it is the principal object of the invention to provide an improved mixing system enabling and increase in gas volume or gas rate being dispersed into a liquid circulated by an axial flow impeller by inhibiting flooding of the impeller.

It is another object of the present invention to provide an improved mixing system for gas dispersion in liquids (which term liquid includes liquid suspensions).

It is another object of the invention to provide an improved mixing system for sparging gas into circulating liquid produced by an axial flow impeller, as exhibited by maintenance of the K factor (ratio of power used by the mixing impeller at constant speed of rotation, while gas is being disbersed to the power used without gas dispersion) with increasing gas rate.

It is a still further object of the present invention to provide an improved gas dispersion mixing system having a gas delivery mechanism (a sparge) which is less prone to clogging than pipe or ring sparges which have conventionally been used for the purpose.

It is a still further object of the present invention providing an improved mixing system for gas/liquid operation in dispersing gas into liquid for mass transfer of the gaseous phase into the liquid phase, which mixing system uses conventional axial flow impellers, thereby simplifying mixing system design because of the efficiency of such impellers (power number) and of the weight thereof, which affects sizing of shafts and other components of the impeller drive.

It is of further object of the present invention to provide an improved mixing system for enhanced gas dispersion or sparging, which system is simple in design requiring only a flat disc co-axial with an axial flow impeller and of sufficient diameter relative to the impeller diameter and in sufficiently close proximity to the impeller to turn axial flow into radial flow which sweeps across the impeller and inhibits the collection of gas on the impeller blades and consequential flooding of the impeller, and also without interference with the dispersion of gas into the liquid circulated by the impeller.

Briefly described, a mixing system for dispersing a gas into a liquid according to this invention utilizes an axial flow impeller rotatable about an axis to provide flow principally along the axis. Hydraulic means are provided for inhibiting flooding of the impeller by the gas and includes a member presenting a surface opposing the axial flow from the impeller and extending radially of the impeller. This surface of this disc is spaced axially away from, but in proximity to the impeller. A sparge releases the gas into the axial flow from the impeller in a region radially outward of the member. The spacing from and radial extent of the surface with respect to the impeller is sufficient to turn the axial flow from the impeller into radial flow over a substantial radial extent of the impeller, up to but not including the tips of the impeller. This radial flow is of velocity sufficient to inhibit the collection of the gas on the impeller and the flooding thereof by the gas.

The foregoing and other objects, features, and advantages of the invention, as well as presently preferred embodiments thereof, will become more apparent from a reading of the following description in connection with the accompanying drawings wherein.

Figure 1:
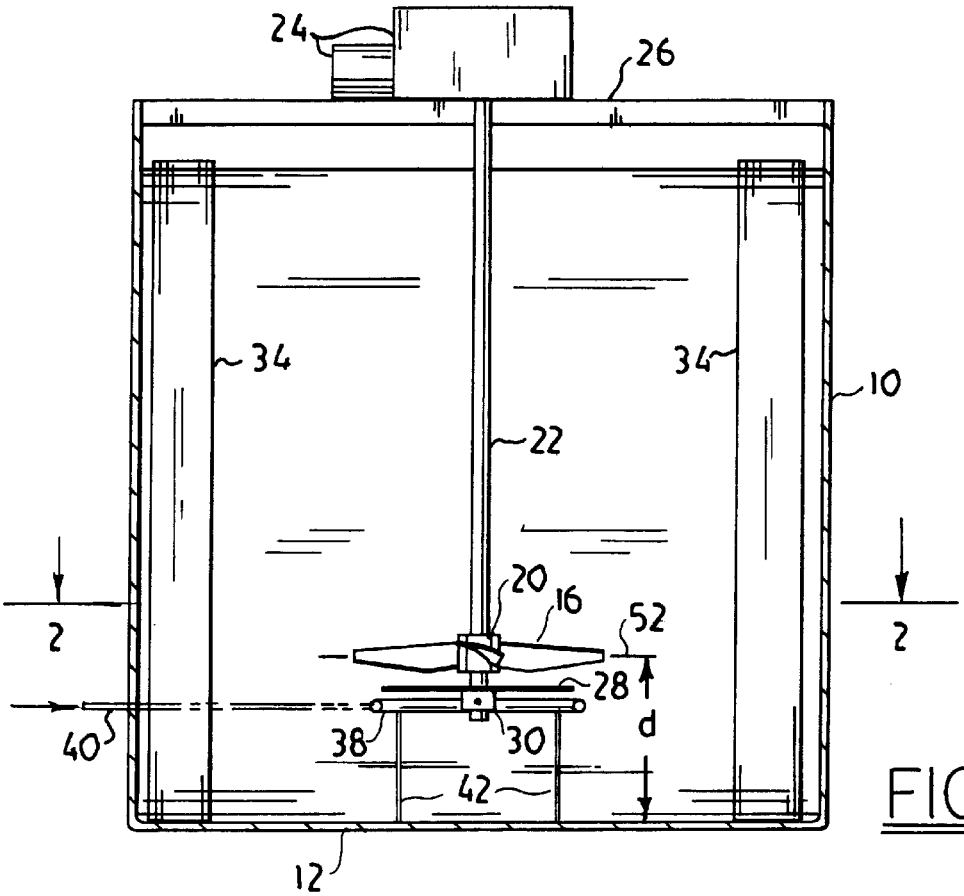
FIG. 1 is a view in elevation and in a vertical section through a tank along a diameter of the tank, which illustrates a mixing system embodying the inventions.
Figure 2:
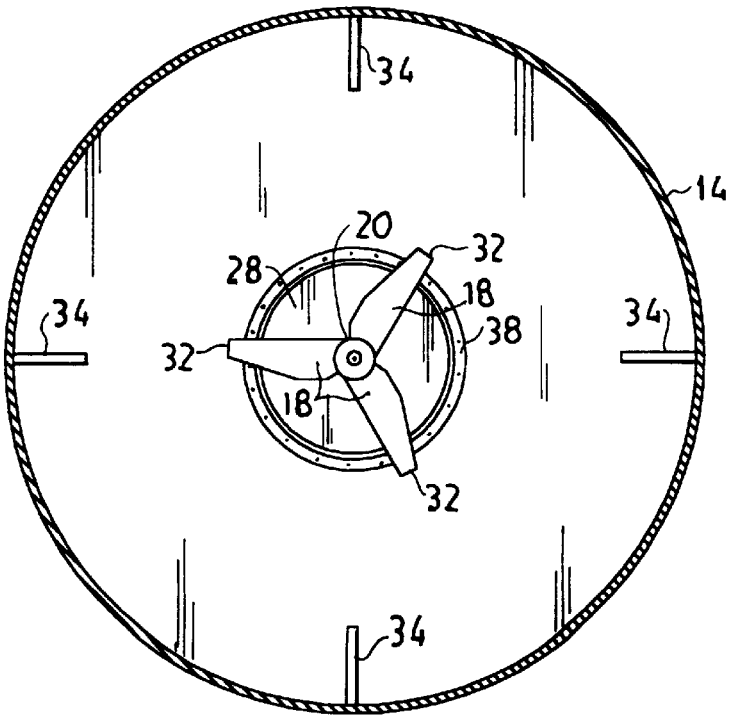
FIG. 2 is a sectional plan view, taken along the line 2—2 in FIG. 1.
Figure 3:
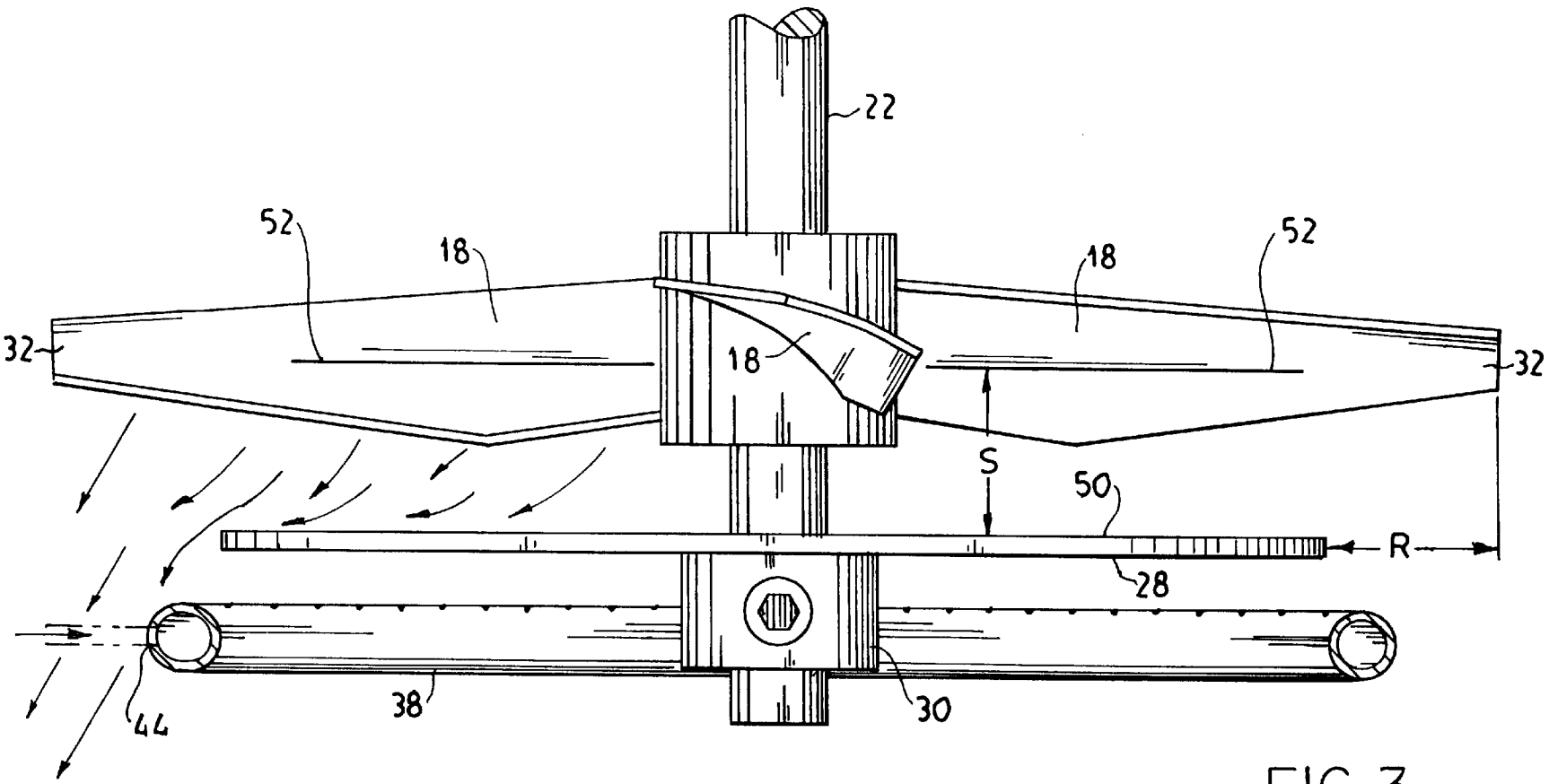
FIG. 3 is an enlarged elevational view showing the impeller, the disc member and a sparge ring and the geometrical relationship thereof which enhances gas handling capability in accordance with the invention.

Referring to FIGS. 1, 2, and 3 there shown a tank 10 having a bottom 12 and a sidewall 14. The tank is filled with liquid which is circulated by a conventional axial flow impeller 16. The impeller 16 has three blades 18 mounted on a hub, 20. The hub is attached to a shaft 22 of a drive system including a motor and gearbox 24 resting on a beam 26 extending over the top of the tank 10. The shaft rotates about a vertical axis, driving the impeller 16 to circulate the liquid in the tank principally in an axial direction. In this embodiment, the impeller 16 is down pumping toward the bottom of the tank, such that the axial flow is downward. The flow is turned radially outward from the shaft 22 (See FIG. 3) because of a member in the form of a disc 28 which is attached to a hub 30 and mounted on the shaft 22 for rotation with the impeller 16. The disc 28 is co-axial with the impeller 16, but is of a diameter less than a diameter of the impeller measured across the circles circumscribed by the tips 32 of the blades 18. The discharge flow from the impeller is increased in velocity because of the confinement of the flow by the disc 28, and continues generally axially toward the bottom 12 of the tank where the flow turns, and the flow is axially upward. Baffles 34, constrain the upward flow to be generally in the axial direction. The flow then turns downwardly, to provide an inlet flow into the upper or suction side of the impeller 16. The impeller 16 may be any conventional type of axial flow impeller. A suitable impeller is the high efficiency type A310 which is available from Lightnin® Mixers of Rochester, N.Y. 14611 USA. Further information about the A310 impeller may be found in U.S. Pat. No. 4,468,130 issued to R. J. Weetman.

A sparge 38 is disposed below the impeller 16 in the outlet flow which is generally axially downward from the tip region of the impeller. The sparge releases gas radially outward of the periphery of the disc 28, but inwardly from the circular path described by the rotation of the tips 32. The sparge 38 may be a ring sparge having a circular tube into which gas is blown from the outside of the tank via a pipe 40. The tube providing the sparge ring 38 may be mounted on legs 42 extending from the bottom of the tank. The sparge ring 38 has a plurality of openings 44 which are in portions of the wall of the sparged tube radially most distance from the center of the sparge ring 38. The ring is desirably co-axial with the shaft 22.

It has been discovered, in accordance with the invention, that collection of gas on the impeller blades 18 and the consequent flooding of the impeller is inhibited when the distance between the surface 50 of the disc, which faces the impeller and is in the path of the discharge flow therefrom, is within a certain spacing or distance from the impeller. This distance may be measured between the midline 52 of the impeller and the surface 50 in the direction axially of the shaft 22. The spacing depends upon the density and viscosity of the liquid in the tank, including any materials suspended in the liquid. When the liquid is water the distance (indicated as S in FIG. 3) is preferably about 7% of the diameter of the impeller. By the diameter of the impeller is meant, the diameter of the circle described by the tips 32 as the impeller rotates. The (S) may vary from 20% to 5% of the impeller diameter, depending upon the characteristics of the liquid being circulated. In other words the spacing is of the order of 10% of the impeller diameter. In any event the spacing is selected to be sufficient to create the radial flow which sweeps across the impeller, removing with the flow, gas which tends to collect on the surfaces of the impeller blades. In effect. the flow creates a pressure differential which decreases in the direction radially outwardly of the blades and promotes the movement of the gas away from the blades. The flow is of maximum velocity and is generally axial near the tips. In order not to interfere with this flow the diameter of the disc 28 is less than the diameter of the impeller. Preferably the diameter of the disc is about 75% of the diameter of the impeller, but can range from 65% to 85% of the diameter of the impeller 26. The gas leaving the sparge tube 38 encounters this high velocity flow and is sheared into bubbles. The bubbles continue towards the bottom of the tank and circulate across the bottom of the tank and then upwardly towards the top of the liquid in the tank. During the circulation the mass of the gas is transferred to the liquid.

Figure 6:
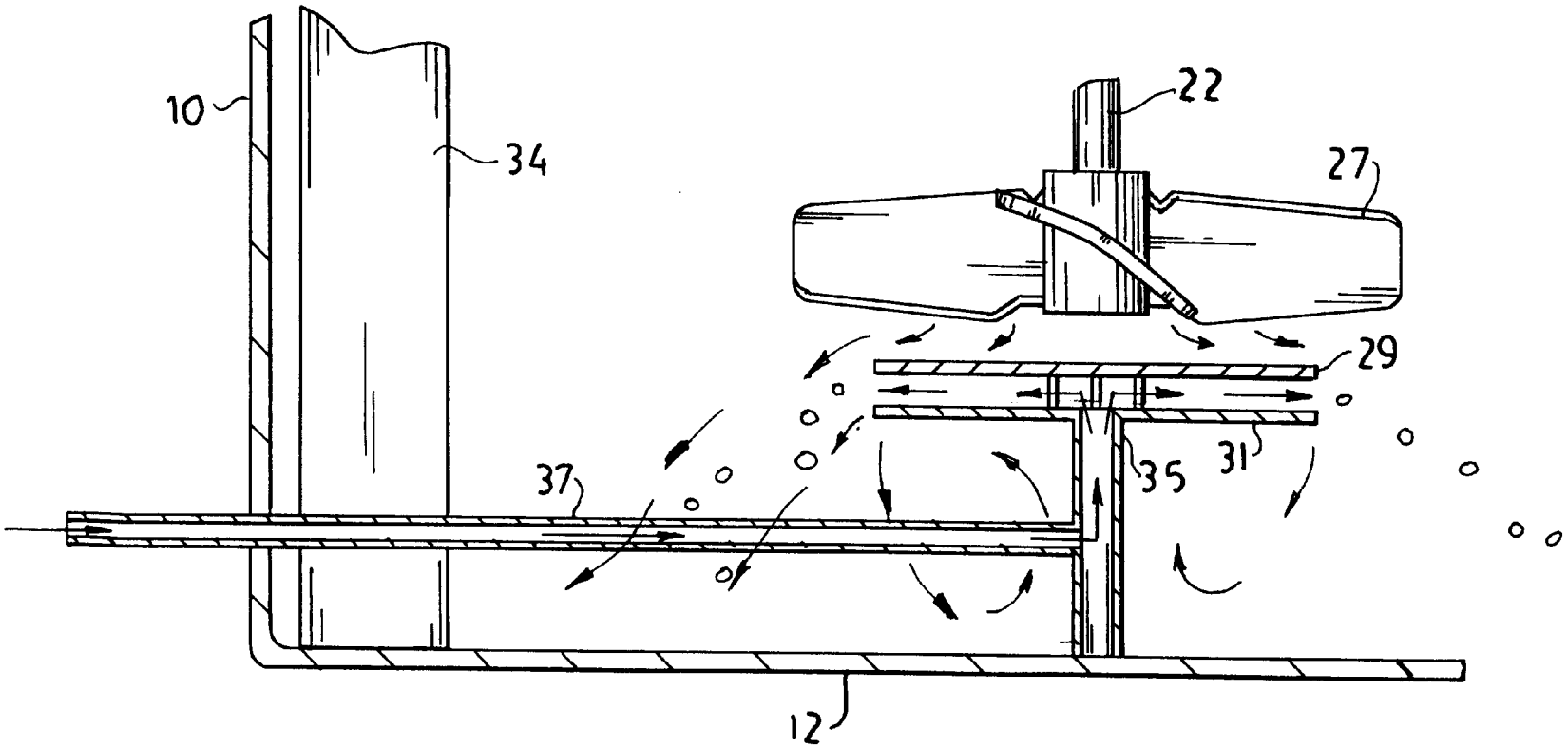
FIG. 6 is a fragmentary and enlarged view of the mixing system shown in FIG. 4 and illustrating the flow and gas dispersion patterns which are believed to occur in the operation of the system.
Figure 7:
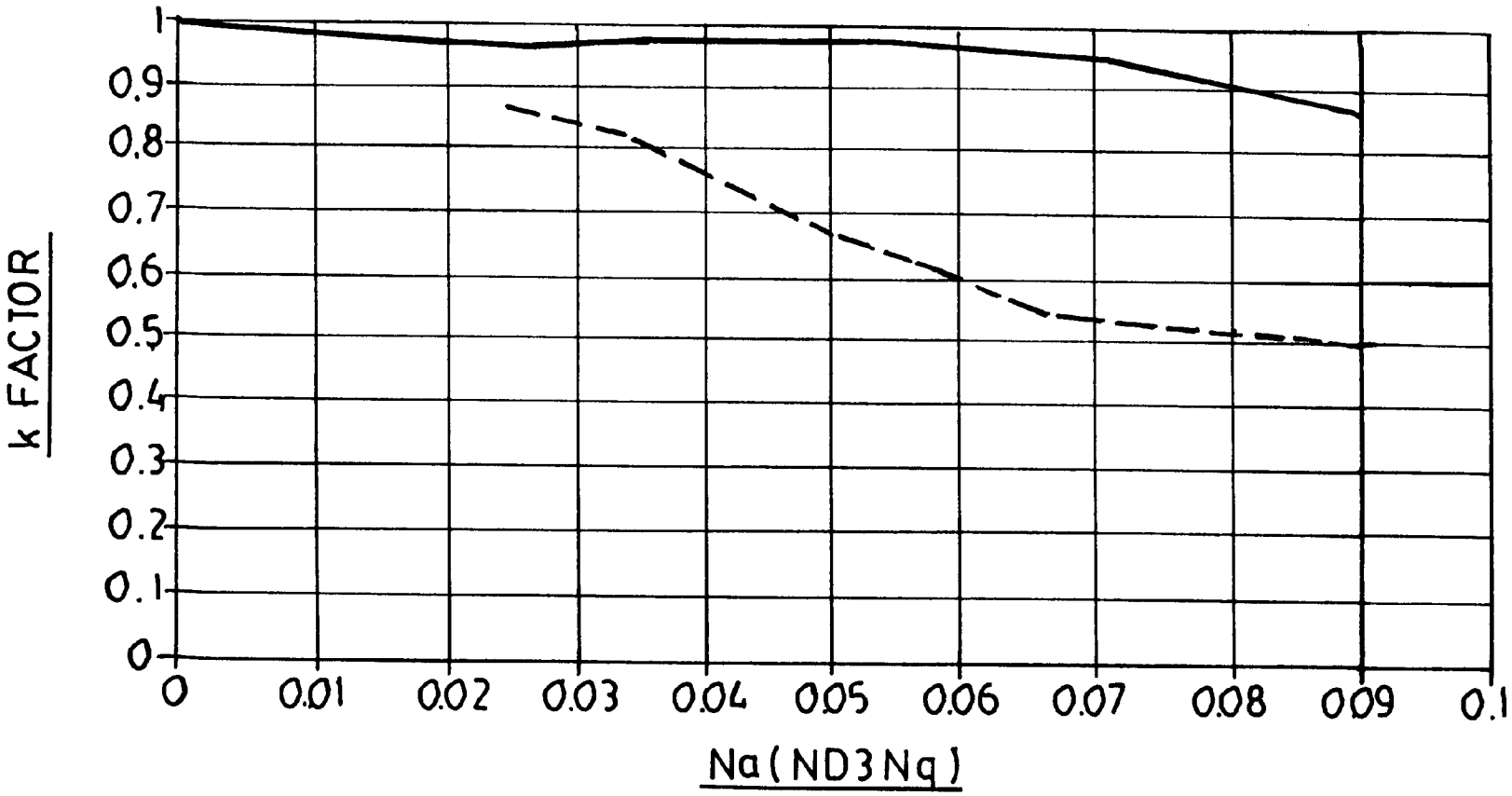
FIG. 7 is a pair of curves showing the K factor without respect to aeration of or gasification number which represents the volume of gas introduced for a volume of liquid being pumped or circulated for a system shown in FIGS. 1, 2 and 3 without the disc in dash lines and with the disc in solid lines, thereby showing the improvement in gas handling capacity afforded by the introduction of the disc.

Referring to FIG. 7 there is shown two curves one in solid lines and the other in dash lines. The curve in dash lines represents a system such as shown in FIGS. 1 through 3, or in FIGS. 4 through 6, but without the disc 28. The X axis of the curve is calibrated in aeration number Na which is function of the volume of air sparged into the tank (the gas rate). Na is related to $N D^3$ Nq where N is the speed of the impeller, D is its diameter and Nq is the flow number. The curves illustrate that the K factor remains essentially constant with increasing aeration number or gas flow rate when the mixing system is equipped with the disc in the above described relationship to the impeller.

FIGS. 1 and 2 illustrate the case where the impeller is spaced from the bottom of the tank by a distance C as measured between the midline of the impeller and the bottom of 12 of the tank. This distance C is preferably about ⅔ of the impeller diameter. C is shown as d in FIG. 1. C is preferably in the range of one impeller diameter or less where the ratio of the diameter of the impeller to the diameter of the tank is approximately ⅓.

Figure 4:
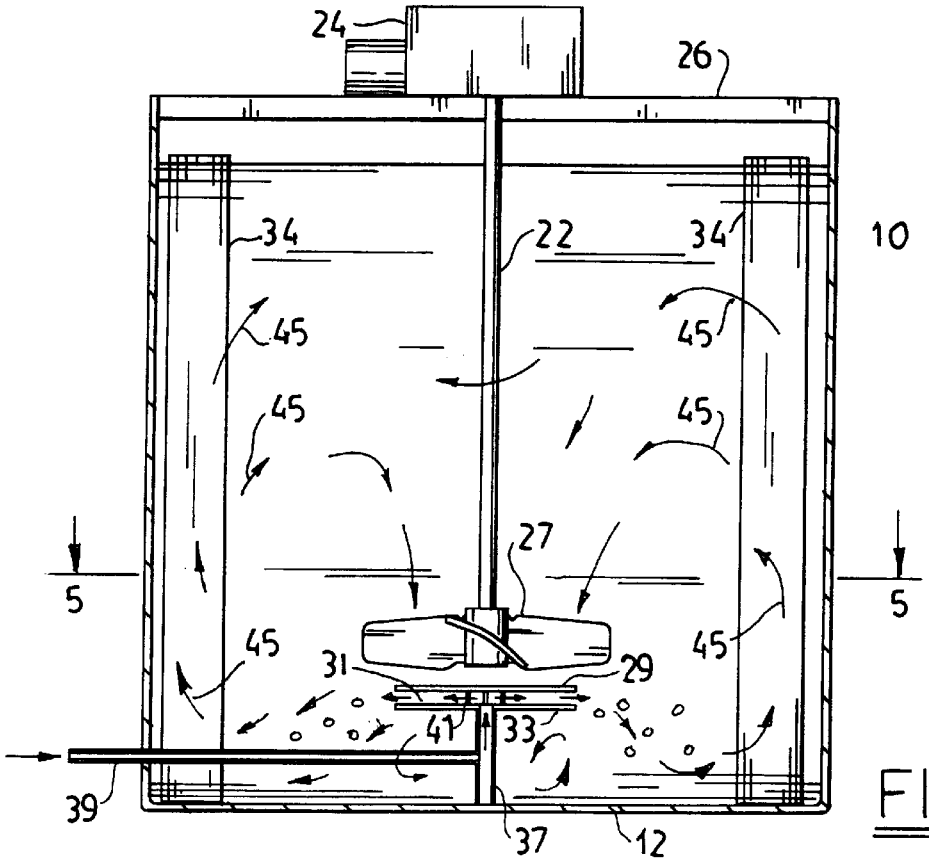
FIG. 4 is a view similar to FIG. 1 of a gas dispersion mixing system in accordance with another embodiment of the invention.
Figure 5:
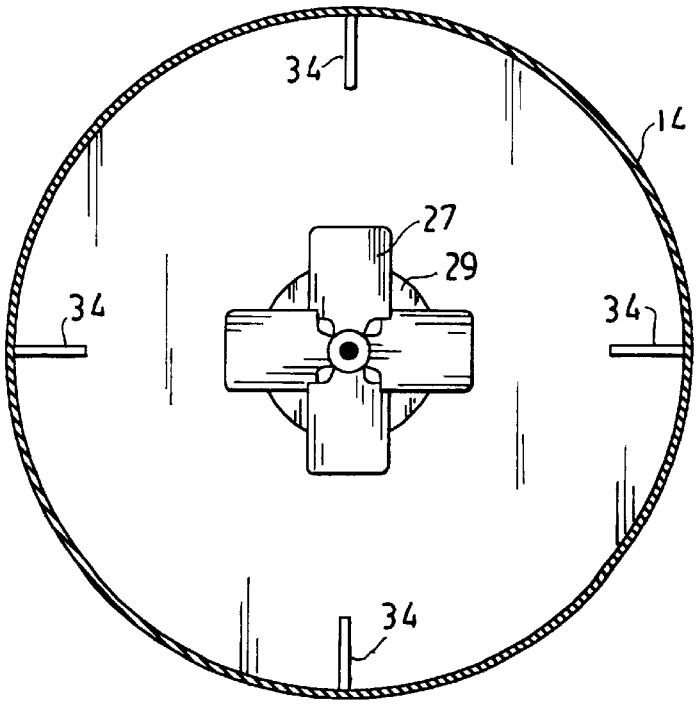
FIG. 5 is a sectional view taken along the line 5—5 in FIG. 4.

Referring to FIGS. 4, 5, and 6 there shown a mixing system which is similar to the system shown in FIGS. 1, 2, and 3, and like parts are identified by the same referenced numerals. The impeller 27 shown is the type A315 which is a four bladed impeller also available from Lightnin Mixers of 135 Mount Read Blvd. Rochester, N.Y. 14611 USA. The A315 impeller is described in Weetman and Howk U.S. Pat. No. 4,896,971 issued Jan. 30, 1990.

The disc 29 is similar in its spacing from the impeller and its diameter relative to the diameter of the impeller 27, as in the case of the disc 28 described above and shown in FIGS. 5 1, 2, and 3. The disc 29 is part of a sparge 31. It is spaced from another disc 33 which is of the same diameter as the disc 29. The disc 33 has a central opening 35 and sits on a stub pipe 37 into which gas to be sparged is blown via a pipe 39. The discs are assembled on and spaced apart by an apertured collar 41. The annular space between the discs 29 and 30 directs the gas to flow outwardly from around the periphery of the space between the discs 29 and 31, into the generally downward and axial flow from the tip region of the impeller 27. The gas is then sheared into bubbles and circulated by the impeller 27 radially towards the side walls of the tank 10 and then axially downwardly as inlet flow to the down pumping impeller 27. The direction of the circulation is shown by the arrows 45.

From the foregoing description it will apparent that there has been provided an improved gas dispersion and mass transfer mixing system wherein flooding is inhibited and gas flow rates without flooding may be two to six times greater than obtainable without the improvements provided by the invention. Variations and modifications, within the scope of the invention, will undoubtedly suggest themselves to those skilled in the art. Accordingly, the foregoing description should be taken as illustrative and not in a limiting sense.

What is claimed is:

1. A mixing system for dispersing a gas into a liquid which comprises an axial flow impeller having blades rotatable about an axis to provide said flow principally along said axis, a member presenting a surface opposing the axial flow from said impeller, said surface extending radially from said impeller and being spaced axially away from said impeller, a sparge releasing gas into a region radially outward of said member in the axial flow from said impeller, said spacing from and said radial extent of said surface with respect to said impeller being sufficiently proximate to said blades across a sufficient radial extent of said blades to turn the axial flow of said impeller into radial flow across said blades of a velocity sufficient to inhibit the collection of gas on said impeller and the flooding thereof by said gas.

2. The system according to claim 1 wherein said spacing is from 5% to 20% of the impeller diameter and said surface has a periphery spaced inwardly from the path circumscribed by the tips of the blades of said impeller as it rotates.

3. A mixing system for dispersing a gas into a liquid which comprises an axial flow impeller having blades rotatable about an axis to provide said flow principally along said axis, a member presenting a surface opposing the axial flow of said impeller, said surface extending radially of said impeller and being spaced axially away from said impeller and inwardly from the tips of said blades, a sparge releasing gas into a region radially outwardly of said member, and said radial extent of said surface with respect to said impeller and the proximity of said surface to said blades being sufficient to turn the axial flow of said impeller into radial flow of a velocity sufficient to inhibit the collection of gas on said impeller and the flooding thereof by said gas, and wherein said impeller has a diameter measured across the path of the tips of the blades thereof as said impeller rotates, said axial spacing of said surface from said impeller measures from the midline of said impeller being in the range of about 5% to 10% of the diameter of the impeller and the radial extent of said surface being about 50% to 85% of the diameter of said impeller.

4. A system according to claim 3 wherein said axial spacing of said surface is 7.5% of the diameter of said impeller and said radial extent of said surface is approximately 75% of the diameter of said impeller.

5. The system according to claim 3 wherein said member is a disc co-axial with said impeller.

6. The system according to claim 5 wherein said disc is rotatable with said impeller and mounted on the same shaft as said impeller.

7. The system according to claim 5 wherein said disc is mounted stationary with respect to said impeller.

8. The system according to claim 3 wherein said region is defined by the periphery of said surface which is disposed radially inward of the path circumscribed by said tips.

9. The system according to claim 3 wherein said member is a disc co-axial with said impeller and said sparge is a tubular ring spaced axially from said impeller further away than said disc in the direction of axial flow from said impeller, said ring having a plurality of holes along the periphery thereof, said ring, where said holes are located, being of a larger diameter than said disc and a smaller diameter than said impeller.

10. The system according to claim 3 wherein said member is a first disc co-axial with said impeller and said sparge comprises a second disc co-axial with said first disc and of about the same diameter as said first disc, said discs defining a space having an inlet for said gas and an outlet for said gas, said outlet being around the periphery of said space.

11. The system according to claim 3 further comprising a tank having a bottom and side walls, said tank containing said liquid to a level above the bottom of said tank in which said impeller, member and sparge are submerged, said impeller providing an axial flow pattern having principally axial flow components downwardly from said impeller towards the bottom of said tank and upwardly along the walls of said tank, said impeller being spaced from said bottom of said tank a distance measured from the midline of said impeller equal about to or less than the diameter of said impeller.

12. The system according to claim 11 wherein said spacing of said impeller to the bottom of said tank is about ⅔ of the diameter of said impeller.

13. The system according to claim 11 wherein the ratio of the diameter of said impeller to the diameter of the tank is about ⅓.

* * * * *